US008139774B2

(12) United States Patent
Berardi et al.

(10) Patent No.: US 8,139,774 B2
(45) Date of Patent: Mar. 20, 2012

(54) MULTI-ELEMENT DIRECTIONAL ACOUSTIC ARRAYS

(75) Inventors: William Berardi, Grafton, MA (US); Michael Dublin, Cambridge, MA (US); Hilmar Lehnert, Framingham, MA (US); Michael W. Stark, Acton, MA (US); Guy Torio, Ashland, MA (US)

(73) Assignee: Bose Corporation, Framingham, MA (US)

( * ) Notice: Subject to any disclaimer, the term of this patent is extended or adjusted under 35 U.S.C. 154(b) by 12 days.

(21) Appl. No.: 12/852,967

(22) Filed: Aug. 9, 2010

(65) Prior Publication Data

US 2011/0216907 A1 Sep. 8, 2011

Related U.S. Application Data

(63) Continuation-in-part of application No. 12/716,309, filed on Mar. 3, 2010.

(51) Int. Cl.
*H04R 5/00* (2006.01)

(52) U.S. Cl. ..... 381/17; 381/300; 381/27

(58) Field of Classification Search ..... 381/333, 381/306, 332, 345, 300, 302, 57–59, 339, 381/1, 17–23, 28, 27, 97, 98; 181/175, 198, 181/199

See application file for complete search history.

(56) References Cited

U.S. PATENT DOCUMENTS 4,616,731 A 10/1986 Robinson
4,747,142 A 5/1988 Tofte
4,942,939 A 7/1990 Harrison
5,197,100 A 3/1993 Shiraki
5,197,103 A 3/1993 Hayakawa
5,261,006 A 11/1993 Nieuwendijk et al.
5,426,702 A 6/1995 Aarts
5,528,694 A 6/1996 Van De Kerkhof et al.
6,075,868 A 6/2000 Goldfarb et al.
6,870,933 B2 3/2005 Roovers
6,928,169 B1 8/2005 Aylward (Continued)

FOREIGN PATENT DOCUMENTS

EP 0608937 A1 8/1994

(Continued)

OTHER PUBLICATIONS

Backgrounder; Technical Overview: Zenith/Bose Television Sound System, Summer/Fall 1986, Zenith Electronics Corporation, 1000 Milwaukee Avenue, Glenview, Illinois 60025, 8 pages.

(Continued)

*Primary Examiner* — Xu Mei
*Assistant Examiner* — Lun-See Lao
(74) *Attorney, Agent, or Firm* — Bose Corporation

(57) ABSTRACT

An audio system including a left input channel signal, a right input channel signal, and a discrete center input channel. Circuitry removes correlated content from the left input channel signal and the right input channel signal and inserts the correlated content into the center input channel signal to provide a modified left input channel signal, a modified right input channel signal, and a modified center input channel signal. The modified left input channel signal is radiated by a directional loudspeaker so that radiation in a direction toward a listening area is less than radiation in other directions. The modified right channel input channel signal is radiated by a directional loudspeaker so that radiation in a direction toward a listening area is less than radiation in other directions.

20 Claims, 8 Drawing Sheets

U.S. PATENT DOCUMENTS

| | | | | |
|---|---|---|---|---|
| 7,016,501 | B1 * | 3/2006 | Aylward et al. | 381/22 |
| 7,283,634 | B2 * | 10/2007 | Smith | 381/20 |
| 7,490,044 | B2 | 2/2009 | Kulkarni | |
| 7,542,815 | B1 | 6/2009 | Berchin | |
| 2005/0078831 | A1 | 4/2005 | Irwan et al. | |
| 2007/0286427 | A1 | 12/2007 | Jung et al. | |
| 2008/0232197 | A1 | 9/2008 | Kojima et al. | |
| 2009/0157575 | A1 | 6/2009 | Schobben et al. | |
| 2009/0225992 | A1 * | 9/2009 | Konagai | 381/17 |
| 2009/0304189 | A1 | 12/2009 | Vinton | |
| 2010/0290630 | A1 | 11/2010 | Berardi et al. | |

FOREIGN PATENT DOCUMENTS

| | | | |
|---|---|---|---|
| EP | 1921890 | A2 | 5/2008 |
| EP | 2099238 | A1 | 9/2009 |
| EP | 2104375 | A2 | 9/2009 |
| JP | 2007037058 | A | 2/2007 |
| WO | 2004075601 | A1 | 9/2004 |
| WO | 2007007083 | A1 | 1/2007 |
| WO | WO 2007/007083 | * | 1/2007 |
| WO | 2009105313 | A1 | 8/2009 |
| WO | 2009134591 | A1 | 11/2009 |

OTHER PUBLICATIONS

International Search Report and Written Opinion dated Apr. 27, 2011 for PCT/US2011/024674.

Moulton Dave, The Center Channel: Unique and Difficult; TV Technology, Published Oct. 5, 2005. Retrieved May 13, 2009 from: http://www.tvtechnology.com/article/11798.

Rubinson Kalman, Music in the Round #4, Stereophile, Published Mar. 2004; Retrieved May 13, 2009 from http://www.stereophile.com/musicintheround/304round/.

Silva Robert, Surround Sound—What You Need To Know, The History and Basics of Surround Sound, Retrieved May 13, 2009 from http://hometheater.about.com/od/beforeyoubuy/a/surroundsound.htm.

Linkwitz Siegfried, Surround Sound, Linkwitz Lab, Accurate Reproduction and Recording of Auditory Scenes, Revised Publication Jan. 15, 2009. Retreived May 13, 2009 from http://www.linkwitzlab.com/surround_system.htm.

International Search Report and Written Opinion dated Nov. 2, 2011 for PCT/US2011/047429.

* cited by examiner

MULTI-ELEMENT DIRECTIONAL ACOUSTIC ARRAYS

REFERENCE TO RELATED APPLICATIONS

This application is a continuation-in-part of, and claims priority to, U.S. patent application Ser. 12/716,309, entitled "Multi-Element Directional Acoustic Arrays", filed Mar. 3, 2010, by Berardi, et al. incorporated herein by reference in its entirety.

BACKGROUND

This specification describes an audio system.

SUMMARY

In one aspect audio system includes a left input channel audio signal, a right input channel audio signal, and a discrete center input channel audio signal; circuitry for removing correlated content from the left input channel audio signal and the right input channel audio signal and inserting the correlated content into the center channel signal, to provide a modified left input channel audio signal, a modified right input channel audio signal, and a modified center input channel audio signal; a first directional loudspeaker, for directionally radiating the modified left audio channel signal so that radiation in a direction toward a listening location is less than radiation in other directions; a second directional loudspeaker, for directionally radiating the modified right channel audio signal so that radiation in a direction toward a listening location is less than radiation in other directions; and a third loudspeaker, for radiating the modified center channel. The first directional loudspeaker may include a first interference array. The second directional loudspeaker may include a second interference array. The second directional loudspeaker may include at least one common acoustic driver. The third loudspeaker may be a third directional loudspeaker for directionally radiating the modified center channel audio signal so that radiation in a direction toward a listening location is less than radiation in other directions. The third loudspeaker may be a third directional loudspeaker for directionally radiating the modified center channel audio signal so that radiation in a direction toward a listening location is greater than radiation in other directions. The third directional loudspeaker may include an interference array. The first directional loudspeaker may include a first interference array; the second directional loudspeaker may include a second interference array; the third directional loudspeaker may include a third interference array; and the first interference array and the third interference array may include a common acoustic driver; and the second interference array and the third interference array may include a common acoustic driver. The audio system may further include an acoustically opaque barrier between the third directional loudspeaker and the listening location. The audio system according may be implemented in a television. An audio system may be mounted in a television and the third loudspeaker may be a third directional loudspeaker, for directionally radiating the modified center channel audio signal so that radiation in a direction toward a listening location is less than radiation in other directions. An audio system may be mounted in a television and the third loudspeaker may be a third directional loudspeaker, for directionally radiating the modified center channel audio signal so that radiation in a direction toward a listening location is greater than radiation in other directions. The third directional loudspeaker may include an interference array.

In another aspect, a method includes receiving a left channel audio signal, a right channel audio signal, and a discrete center channel audio signal; removing correlated content from the left channel audio signal and the right channel audio signal to provide a modified left channel audio signal and a modified right channel audio signal; combining the correlated content with the discrete center channel audio signal; radiating the modified left channel audio signal and the modified right audio channel audio signal directionally so that the radiation toward a listening position is less than the radiation in other directions. The radiating the modified left channel audio signal may include radiating with a first interference array and the radiating the modified right channel audio signal may include radiating with a second interference array. The first interference array and the second interference array comprise a common acoustic driver.

In another aspect, audio signal circuitry includes circuitry to remove correlated content from a left channel audio signal and a right channel audio signal to provide a modified left channel audio signal and a modified right channel audio signal; circuitry to combine the correlated content with a discrete center channel audio signal to provide a modified discrete center channel; and first processing circuitry to process the modified left channel audio signal so that the modified left channel audio signal is directionally radiatable by a first interference array; and second processing circuitry to process the modified right channel audio signal so that the modified right channel audio signal is directionally radiatable by a second interference array. The first processing circuitry may process the modified left channel audio signal and the second processing circuitry may modifies right channel audio signal so that the first interference array and the second interference array include a common acoustic driver. The audio signal processing circuitry may further include third processing circuitry to process the modified discrete center channel so that the modified discrete center channel is directionally radiatable by an interference array. The third circuitry may process the modified discrete center channel so that the third directional array and the first directional array have a common acoustic driver and so that the third directional array and the second directional array have a common acoustic driver.

Other features, objects, and advantages will become apparent from the following detailed description, when read in connection with the following drawing, in which:

DETAILED DESCRIPTION

Figure 1:
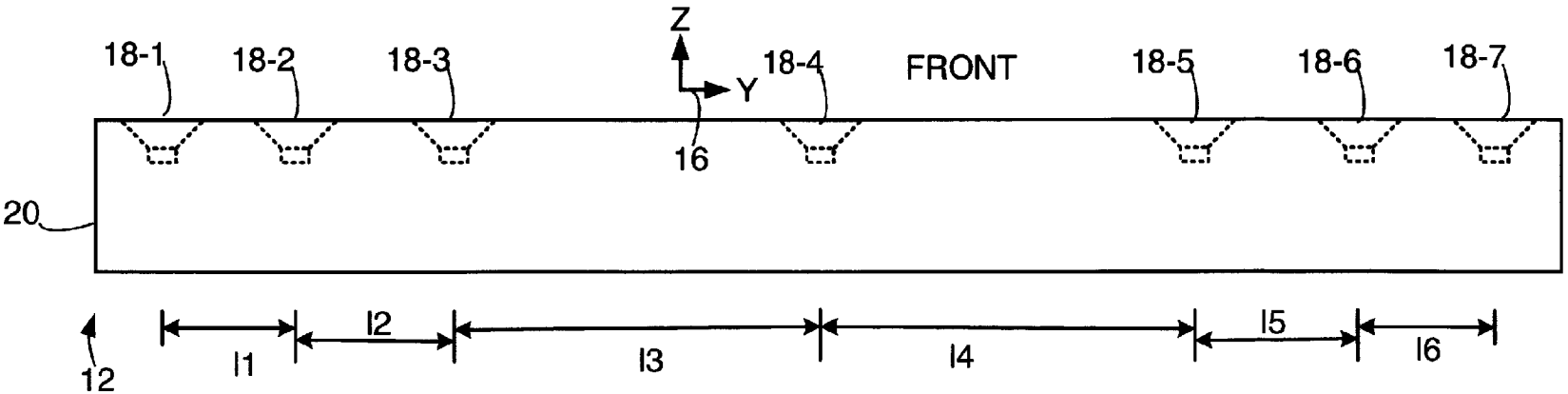
FIG. 1 is a top diagrammatic view and a front diagrammatic view of an audio module.
Figure 1:
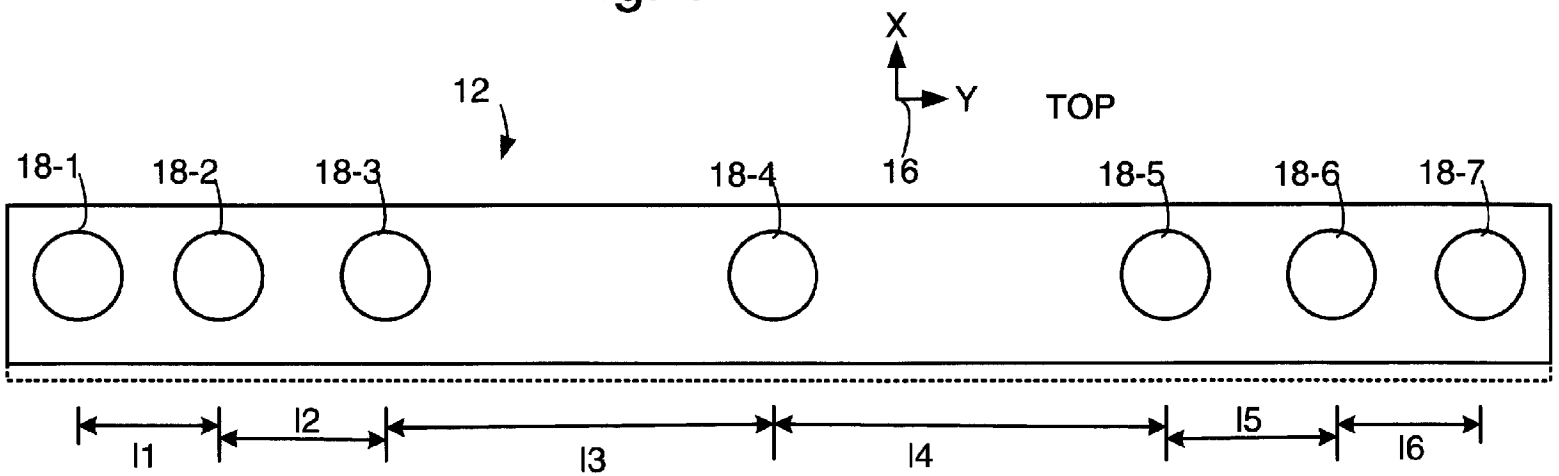

Though the elements of several views of the drawing may be shown and described as discrete elements in a block diagram and may be referred to as "circuitry", unless otherwise indicated, the elements may be implemented as one of, or a combination of, analog circuitry, digital circuitry, or one or more microprocessors executing software instructions. The software instructions may include digital signal processing (DSP) instructions. Operations may be performed by analog circuitry or by a microprocessor executing software that performs the mathematical or logical equivalent to the analog operation. Unless otherwise indicated, signal lines may be implemented as discrete analog or digital signal lines, as a single discrete digital signal line with appropriate signal processing to process separate streams of audio signals, or as elements of a wireless communication system. Some of the processes may be described in block diagrams. The activities that are performed in each block may be performed by one element or by a plurality of elements, and may be separated in time. The elements that perform the activities of a block may be physically separated. Unless otherwise indicated, audio signals or video signals or both may be encoded and transmitted in either digital or analog form; conventional digital-to-analog or analog-to-digital converters may not be shown in the figures. For simplicity of wording "radiating acoustic energy corresponding to the audio signals in channel x" will be referred to as "radiating channel x."

FIG. 1 shows a top view and a front view of an audio module 12 including a plurality, in this embodiment seven, of acoustic drivers 18-1-18-7. One of the acoustic drivers 18-4 is positioned near the lateral center of the module, near the top of the audio module. Three acoustic drivers 18-1-18-3 are positioned near the left extremity 20 of the audio module and are closely and non-uniformly spaced, so that distance $l1 \neq l2$, $l2 \neq l3$, $l1 \neq 3$. Additionally, the spacing may be arranged so that $l1 < l2 < l3$. Similarly, distance $l6 \neq l5$, $l5 \neq l4$, $l6 \neq 4$. Additionally, the spacing may be arranged so that $l6 < l5 < l4$. In one implementation, $l1 = l6 = 55$ mm, $l2 = l5 = 110$ mm, and $l3 = l4 = 255$ mm. The device of FIG. 1 may be a standalone audio device, or may be implemented in a television set, as is shown below. Direction indicator 16 shows the intended orientation of the audio module 12 in use. While the concepts disclosed herein are illustrated with the audio module of FIG. 1, the principles may be implemented with other forms of directional loudspeakers and in other configurations.

Figure 2:
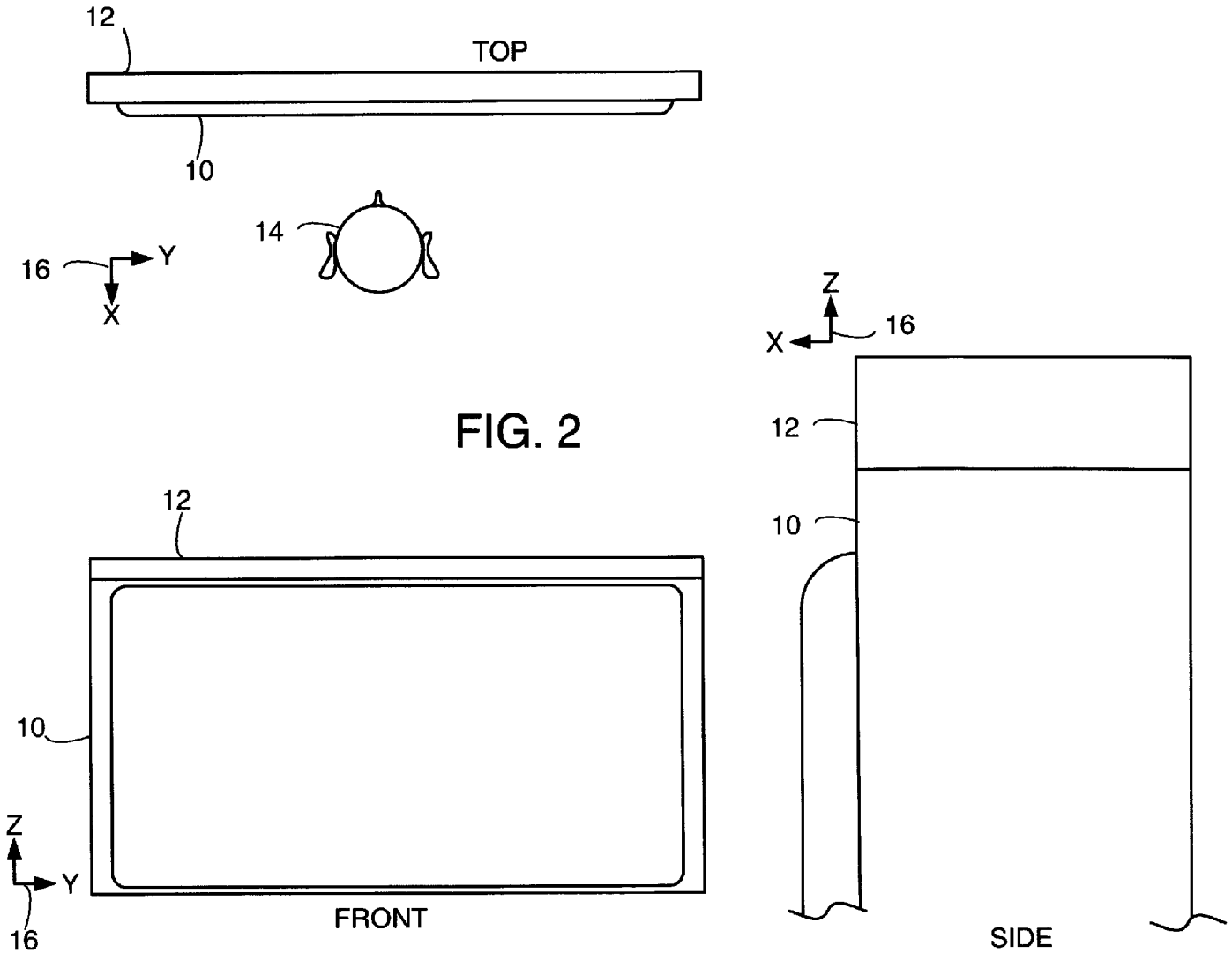
FIG. 2 is a top diagrammatic view, a front diagrammatic view, and a side diagrammatic view of a television including the audio module of FIG. 1.

The audio module 12 of FIG. 1 is particularly beneficial when used with, or integrated in, a television or similar media device. FIG. 2 shows a top view, a side view, and a front view of a television 10 with an audio module 12 of FIG. 1 included in the television console. The audio module is substantially linear and extends horizontally across the television, above the screen. In other implementations, the audio module may be positioned below the screen. More detail of the audio module is shown in subsequent figures. A listener 14 is shown in the top view, which along with direction indicator 16 shows the orientation of the television.

Figure 3C:
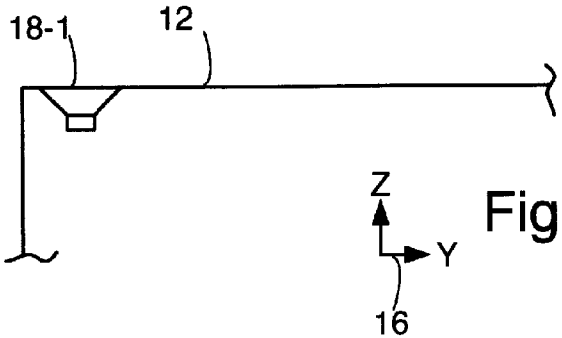
FIG. 3C-3E are front diagrammatic views of an end acoustic driver of the audio module.
Figure 3D:
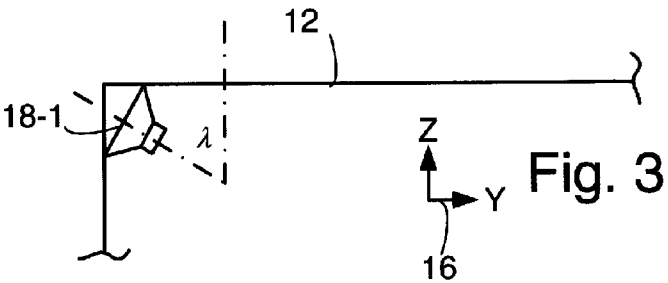
Figure 3E:
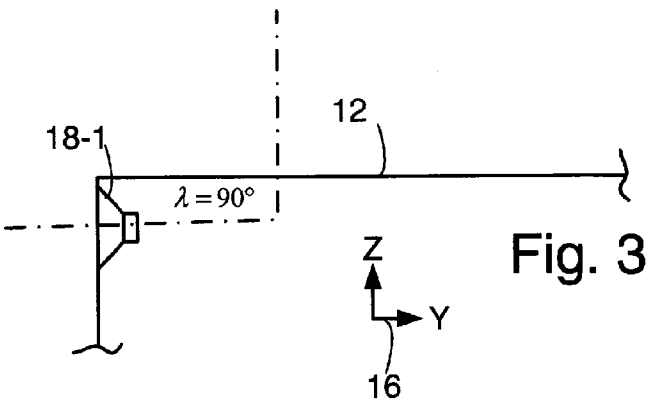
Figure 3A:
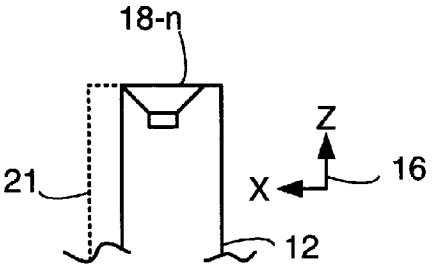
FIGS. 3A and 3B are side diagrammatic views showing one or more of the acoustic drivers of the audio module.
Figure 3B:
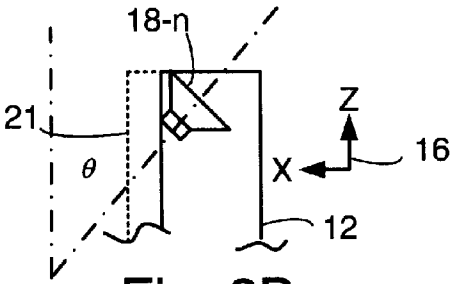

FIGS. 3A-3E show some variations of the orientations of one or more of the acoustic drivers 18-1-18-7. In the side view of FIG. 3A, the acoustic driver 18-n (where n=1-7), is upward firing, that is, the radiating surface faces upwards. In the side view of FIG. 3B, the acoustic driver 18-n is oriented so that the radiating surface faces upward and backward at an angle θ, greater than 0 degrees and less than 90 degrees, relative to vertical. In the front view of FIG. 3C, the acoustic driver 18-1 closest to the left extremity of the acoustic module 12 is oriented substantially directly upward. In the front view of FIG. 3D, the acoustic driver 18-1 closest to the left extremity of the acoustic module 12 is oriented upward and outward at an angle λ relative to vertical. In FIG. 3E, the acoustic driver 18-1, angle λ is 90 degrees, so that the acoustic driver is side-firing, that is facing sidewards. The mirror image of FIGS. 3D and 3E can be used with acoustic driver 18-7. The orientation of FIG. 3D can be implemented with acoustic driver 18-2 or 18-3 or both. The minor image of FIG. 3D can be implemented with acoustic driver 18-5 or 18-6 or both. One or more of the acoustic drivers may be in an orientation that is a combination of the orientations of FIGS. 3A-3E; for example, an acoustic driver may be tilted backward and outward relative to vertical. In one implementation, acoustic drivers 18-2-18-6 are tilted backward so that angle θ is 27±5% degrees and acoustic drivers 18-1 and 18-7 are replaced by a directional speaker such as is described in U.S. Pat. Published Pat. App. 2009/0274329A1, configured so that the radiation is substantially sideward.

Orienting the acoustic drivers according to FIGS. 3A-3E, together with signal processing as described below, causes more or the total acoustic radiation arriving at the listener to be indirect radiation than is the case with conventional audio systems. A greater proportion of the acoustic radiation being indirect radiation results in a desirable spacious acoustic image.

Causing as much as possible of the acoustic radiation experienced by the listener to be indirect radiation is accomplished by forming interference type directional arrays consisting of subsets of the acoustic drivers 18-1-18-7. Interference type directional arrays are discussed in U.S. Pat. No. 5,870,484 and 5,809,153. At frequencies at which the individual acoustic drivers radiate substantially omnidirectionally (for example frequencies with corresponding wavelengths that are more than twice the diameter of the radiating surface of the acoustic drivers), radiation from each of the acoustic drivers interferes destructively or non-destructively with radiation from each of the other acoustic drivers. The combined effect of the destructive and non-destructive interference is that the radiation is some directions is significantly less, for example, −14 dB, relative to the maximum radiation in any direction. The directions at which the radiation is significantly less than the maximum radiation in any direction will be referred to as "null directions". Causing more radiation experienced by a listener to be indirect radiation is accomplished by causing the direction between the audio module and the listener to be a null direction.

At frequencies with corresponding wavelengths that are less than twice the diameter of the radiating surface of an acoustic driver, the radiation pattern becomes less omnidirectional and more directional, until at frequencies with corresponding wavelengths that are equal to or less than the diameter of the radiating surface of an acoustic driver, the radiation patterns of the individual driver becomes inherently directional. At these frequencies, there is less destructive and non-destructive interference between the acoustic drivers of the array, and the acoustic image tends to collapse to the individual acoustic drivers. However, if the acoustic drivers are oriented according to FIGS. 3A-3E, even at frequencies with corresponding wavelengths that are equal to or less than the diameter of the radiating surface, the listener experiences indirect radiation. A result is that the perceived source is diffuse and somewhere other than at the acoustic driver. In addition, the barrier 21 deflects radiation so that it reaches the listener indirectly. The barrier has the additional advantage that it hides the acoustic drivers and protects them from damage from the front of the television.

Figure 4A:
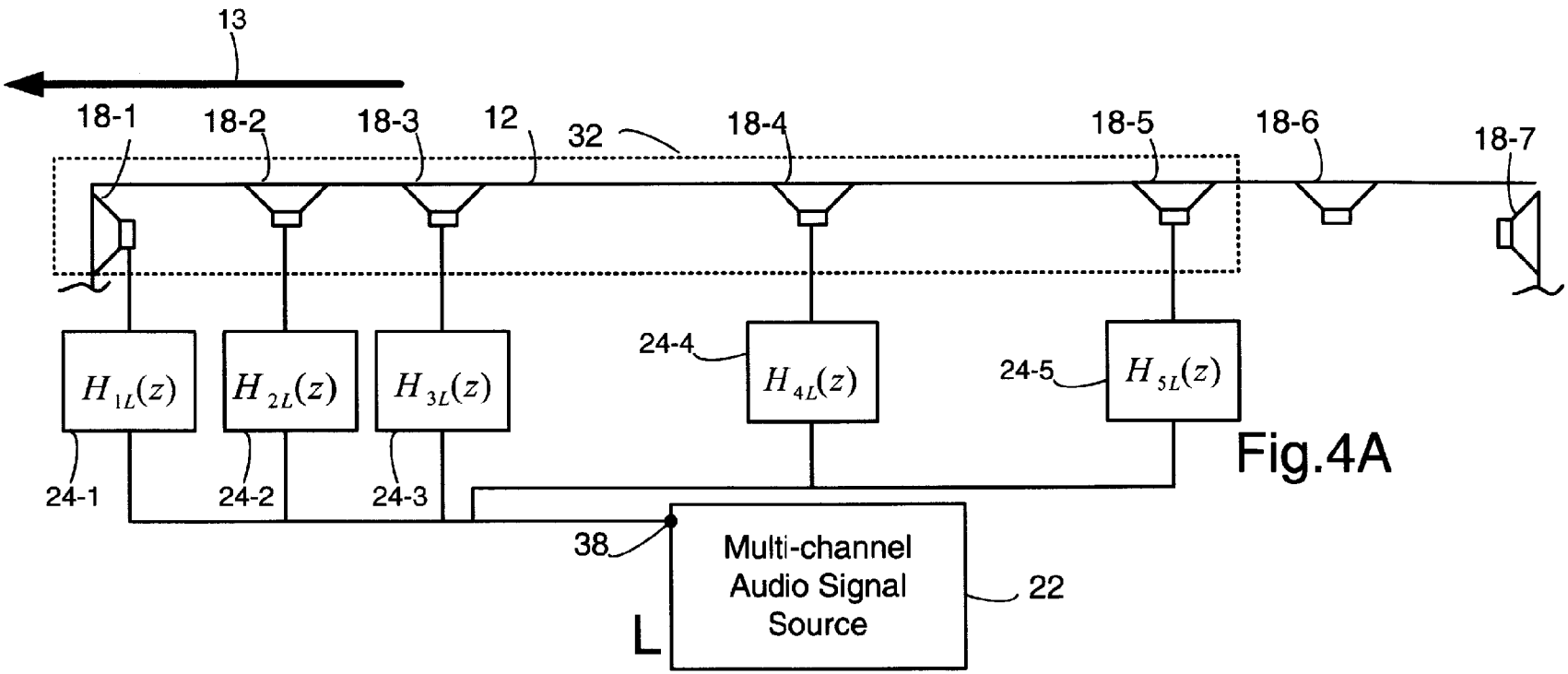
FIGS. 4A-4D are each diagrammatic views of the audio module, showing the configuration of one of the directional arrays.

FIG. 4A shows a diagrammatic view of audio module 12, showing the configuration of directional arrays of the audio module. The audio module is used to radiate the channels of a multi-channel audio signal source 22. Typically, a multi-channel audio signal source for use with a television has at least a left (L), right (R), and Center (C) channel. In FIG. 4A, the left channel array 32 includes acoustic drivers 18-1, 18-2, 18-3, 18-4, and 18-5. The acoustic drivers 18-1-18-5 are coupled to the left channel signal source 38 by signal processing circuitry 24-1-24-5, respectively that apply signal processing represented by transfer function $H_{1L}(z)$-$H_{5L}(z)$, respectively. The effect of the transfer functions $H_{1L}(z)$-$H_{5L}(z)$ on the left channel audio signal may include one or more of phase shift, time delay, polarity inversion, and others. Transfer functions $H_{1L}(z)$-$H_{5L}(z)$ are typically implemented as digital filters, but may be implemented with equivalent analog devices.

In operation, the left channel signal L, as modified by the transfer functions $H_{1L}(z)$-$H_{5L}(z)$ is transduced to acoustic energy by the acoustic drivers 18-1-18-5. The radiation from the acoustic drivers interferes destructively and non-destructively to result in a desired directional radiation pattern. To achieve a spacious stereo image, the left array 32 directs radiation toward the left boundary of the room as indicated by arrow 13 and cancels radiation toward the listener. The use of digital filters to apply transfer functions to create directional interference arrays is described, for example, in Boone, et al., *Design of a Highly Directional Endfire Loudspeaker Array*, J. Audio Eng. Soc., Vol 57. The concept is also discussed with regard to microphones van der Wal et al., *Design of Logarithmically Spaced Constant Directivity-Directivity Transducer Arrays*, J. Audio Eng. Soc., Vol. 44, No. 6, June 1996 (also discussed with regard to loudspeakers), and in Ward, et al., Theory and design of broadband sensor arrays with frequency invariant far-field beam patterns, J. Acoust. Soc. Am. 97 (2), February 1995. Mathematically, directional microphone array concepts may generally be applied to loudspeakers.

Figure 4B:
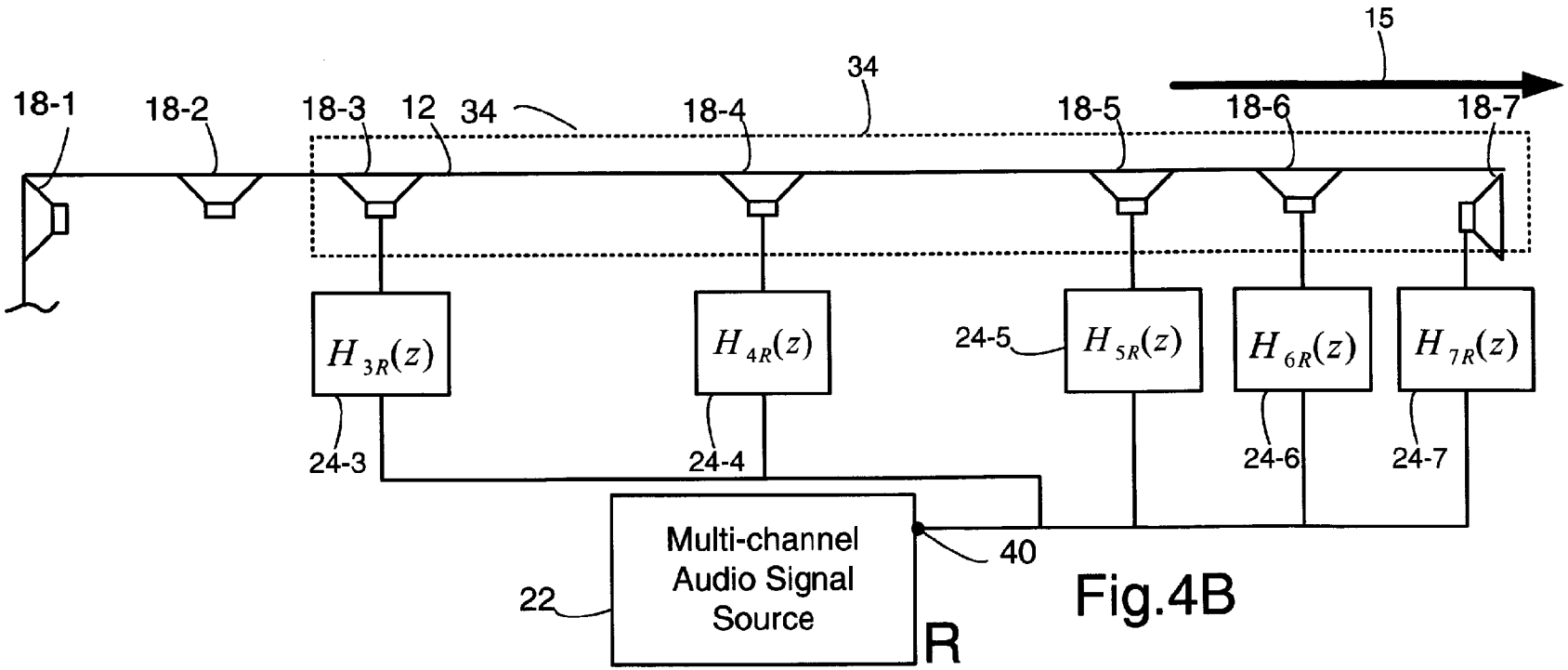

Similarly, in FIG. 4B, the right channel array 34 includes acoustic drivers 18-3, 18-4, 18-5, 18-6, and 18-7. The acoustic drivers 18-3-18-7 are coupled to the right channel signal source 40 but signal processing circuitry 24-3-24-7, respectively that apply signal processing represented by transfer function $H_{3R}(z)$-$H_{7R}(z)$, respectively. The effect of the transfer functions $H_{3R}(z)$-$H_{7R}(z)$ may include one or more of phase shift, time delay, polarity inversion, and others. Transfer functions $H_{3R}(z)$-$H_{7R}(z)$ are typically implemented as digital filters, but may be implemented with equivalent analog devices.

In operation, the left channel signal L, as modified by the transfer functions $H_{3R}(z)$-$H_{7R}(z)$ is transduced to acoustic energy by the acoustic drivers 18-3-18-7. The radiation from the acoustic drivers interferes destructively and non-destructively to result in a desired directional radiation pattern. To achieve a spacious stereo image, the right array 34 directs radiation toward the right boundary of the room as indicated by arrow 15 and cancels radiation toward the listener.

Figure 4C:
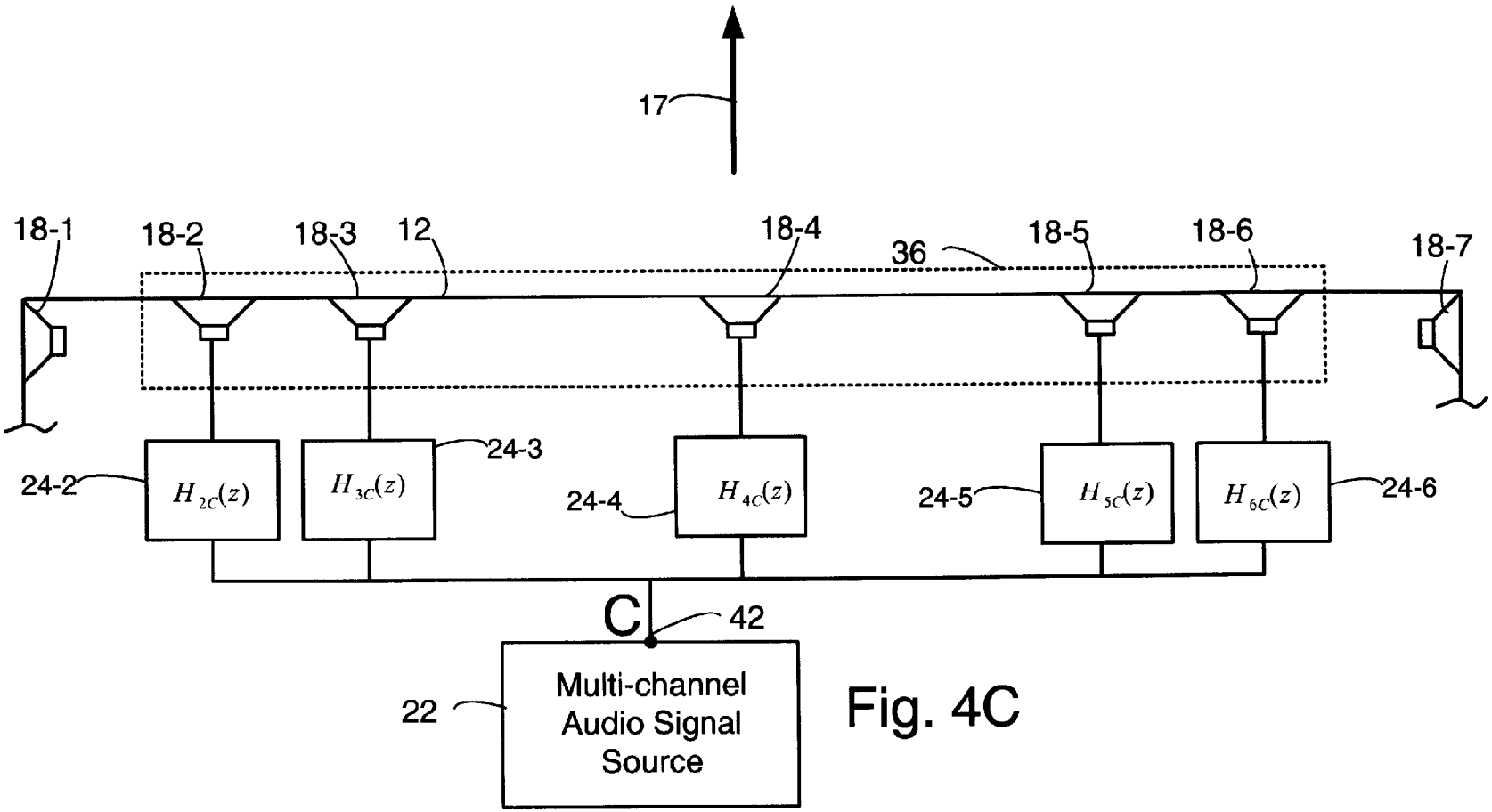

In FIG. 4C, the center channel array 36 includes acoustic drivers 18-2, 18-3, 18-4, 18-5, and 18-6. The acoustic drivers 18-2-18-6 are coupled to the center channel signal source 42 by signal processing circuitry 24-2-24-6, respectively that apply signal processing represented by transfer function $H_{2C}(z)$-$H_{6C}(z)$, respectively. The effect of the transfer functions $H_{2C}(z)$-$H_{6C}(z)$ may include one or more of phase shift, time delay, polarity inversion, and others. Transfer functions $H_{2C}(z)$-$H_{6C}(z)$ are typically implemented as digital filters, but may be implemented with equivalent analog devices.

In operation, the center channel signal C, as modified by the transfer functions $H_{2C}(z)$-$H_{2C}(z)$ is transduced to acoustic energy by the acoustic drivers 18-2-18-6. The radiation from the acoustic drivers interferes destructively and non-destructively to result in a desired directional radiation pattern.

Figure 4D:
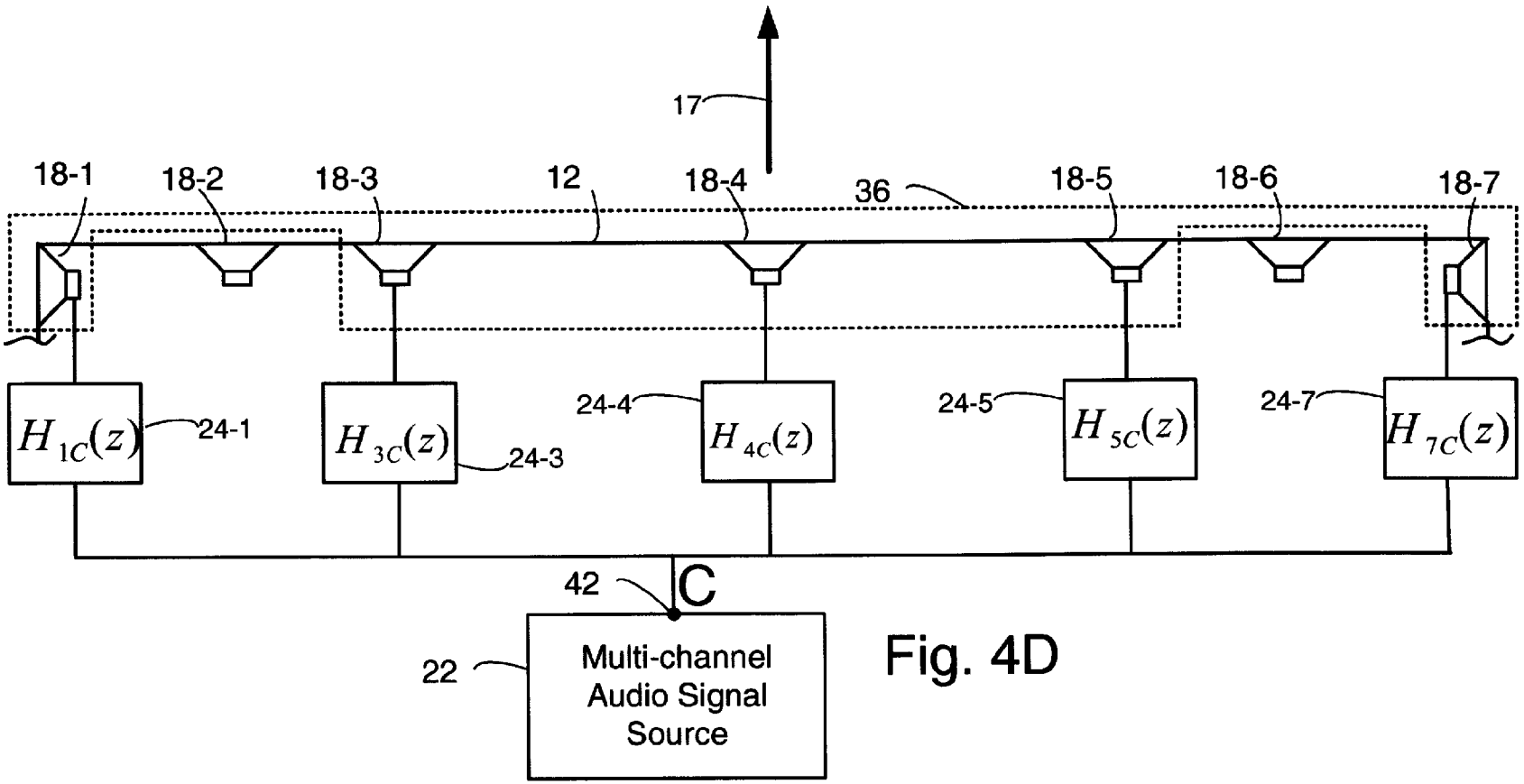

An alternative configuration for the center channel array is shown in FIG. 4D, in which the center channel array 36 includes acoustic drivers 18-1, 18-3, 18-4, 18-5, and 18-7. The acoustic drivers 18-1, 18-3-18-5, and 18-7 are coupled to the center channel signal source 42 by signal processing circuitry 24-1, 24-3-24-5, and 24-7, respectively that apply signal processing represented by transfer function $H_{1C}(z)$, $H_3(z)$-$H_{5C}(z)$, and $H_{7C}(z)$, respectively. The effect of the transfer functions $H_{1C}(z)$, $H_{3C}(z)$-$H_{5C}(z)$), and $H_{7C}(z)$,may include one or more of phase shift, time delay, polarity inversion, and others. Transfer functions $H_{1C}(z)$, $H_{3C}(z)$-$H_{5C}(z)$), and $H_{7C}(z)$ are typically implemented as digital filters, but may be implemented with equivalent analog devices.

In operation, the left channel signal C, as modified by the transfer functions $H_{1C}(z)$, $H_{3C}(z)$-$H_{5C}(z)$), and $H_{7C}(z)$ is transduced to acoustic energy by the acoustic drivers 18-1, 18-3-18-5, and 18-7. The radiation from the acoustic drivers interferes destructively and non-destructively to result in a desired directional radiation pattern.

The center channel array 38 of FIGS. 4C and 4D directs radiation upward, as indicated by arrow 17 and backward and cancels radiation toward the listener.

At high frequencies (for example, at frequencies with corresponding wavelengths less than three times the distance between the array elements), the stereo image may tend to "collapse" toward the more closely spaced acoustic drivers of the arrays. If the directional array has array elements in the center of the array are more closely spaced than the elements at the extremities (as in, for example, "nested harmonic" directional arrays or in logarithmically spaced arrays, for example as described in the van der Wal paper mentioned above), the stereo image will collapse toward the center of the array.

One way of preventing the collapse toward the center of the array is to form three arrays, one array of closely spaced elements adjacent the left end of the acoustic module, one at the center of the acoustic module, and one at the right end of the acoustic module. However, this solution requires many acoustic drivers, and is therefore expensive. For example, forming a five element left, center, and right channel arrays would require fifteen acoustic drivers.

An acoustic module according to FIGS. 4A-4D allows for left, center, and right arrays and greatly reduces the amount of collapse of the acoustic image toward the center of the array, with fewer acoustic drivers. Since the collapse tends to be toward the more closely spaced elements, if there is any collapse of the left channel is to the left end of the acoustic module 12 and if there is any collapse of the right channel, it is to the right end of the acoustic module 12 as opposed toward the middle of the acoustic image, which would be the case if the more closely spaced acoustic drivers were near the lateral middle of the acoustic module. Additionally, an audio system according to FIGS. 4A-4D provides a wider portion of the listening area that receives indirect radiation, and therefore has a more diffuse, pleasing stereo image, than an audio system with a directional array at the lateral middle of the television screen.

Causing acoustic radiation experienced by the listener to be indirect radiation can result, in some situations, in an acoustical image being different than when radiated by conventional loudspeaker systems in which most of the radiation experienced by the user is direct radiation. For example, some music videos are mixed so that the acoustic image of a vocalist is centered, but so that it is more diffuse than the acoustic image of an actor speaking dialogue in a reproduction of a motion picture. One method of creating such an image is to insert some of the vocalist track into the left and right channels. When reproduced on a conventional stereo or 5.1 channel reproduction system, the insertion of the vocalist track into the left and right channels can have the desired effect of creating a diffuse, centered acoustic image. However, when reproduced on a reproduction system according to FIGS. 1-4D, the acoustic image of the vocalist may be more diffuse than when reproduced on the conventional stereo of 5.1 channel reproduction system.

Figure 5:
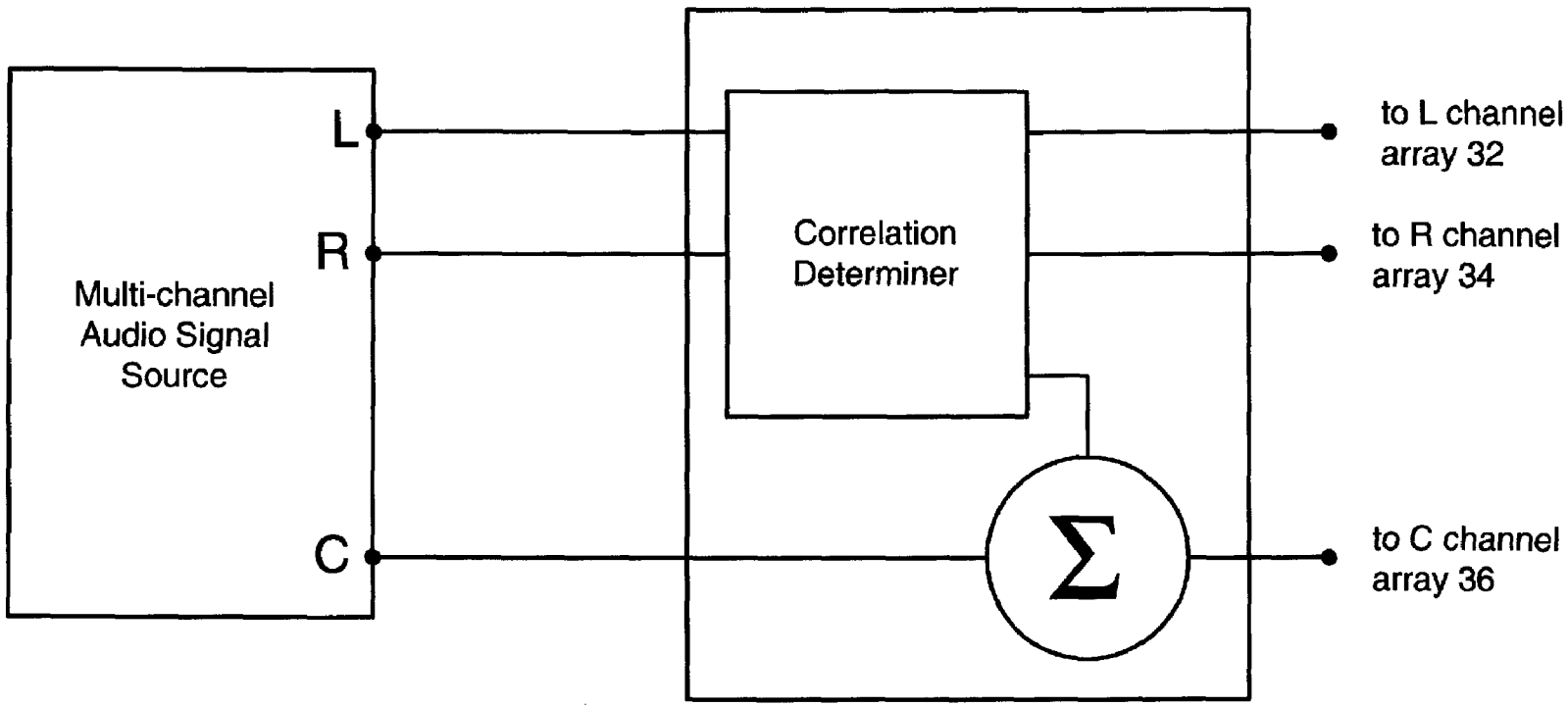
FIG. 5 is a block diagram of an audio signal processing system.

FIG. 5 shows the audio processing system of FIGS. 4A-4D with an additional element. Channel modifier 122 couples multi-channel audio signal source 22 with directional arrays 32, 34, and 36. The channel modifier 122 includes a correlation determiner 100 and a signal combiner 102. The left channel signal, represented by line 138 and right channel signal, represented by line 140 are coupled to correlation determiner 100. Correlation determiner 100 is coupled to modified left channel signal source 38', to modified right channel signal source 40', and to signal combiner 102. A discrete center channel signal, represented by line 142 is coupled to signal combiner 102. The signal combiner 102 is coupled to modified center channel signal source 42'. Modified left channel signal source 38', modified right channel signal source 40', and modified center channel signal source 42' are coupled to left channel array 32, right channel array 34, and center channel array 36, respectively, as shown if FIGS. 4A-4D.

In operation, the correlation determiner 100 removes some or all of the correlated content in the left channel audio signal, represented by line 138, and the right channel audio signal, represented by line 140 and combines the correlated content removed from the left channel audio signal and the right channel audio signal with the center channel audio signal, represented by line 142. The modified left channel audio signal, the modified right channel audio signal, and the modified center channel audio signal are then processed as described above.

The correlation determiner 100 and the signal combiner may be implemented by analog circuitry, but are most conveniently implemented by one or more digital signal processors executing digital signal processing instructions. The digital signal processors may also implement the transfer functions of FIGS. 4A-4D.

The elements of FIG. 5 have been described as implemented in an audio system as described in FIGS. 1-4D. However, the elements of FIG. 5 can be beneficially implemented in any multi-channel audio system having a discrete center channel and which causes more radiation to reach a listener indirectly than directly.

In alternate embodiment, the loudspeakers may be configured, oriented, and positioned, and the transfer functions selected so that the center channel array 38 of FIGS. 4C and 4D directs radiation toward the listener.

The audio processing system of FIG. 5 can be beneficially combined with the audio system described in U.S. patent application Ser. No. 12/465,146. In the situation described above, the correlated content removed from the left and right channels may be combined with the music center channel, which is described in U.S. patent application Ser. No. 12/465,146.

Numerous uses of and departures from the specific apparatus and techniques disclosed herein may be made without departing from the inventive concepts. Consequently, the invention is to be construed as embracing each and every novel feature and novel combination of features disclosed herein and limited only by the spirit and scope of the appended claims.

What is claimed is:

1. An audio system, comprising:

a left input channel audio signal, a right input channel audio signal, and a discrete center input channel audio signal;

circuitry for removing correlated content from the left input channel audio signal and the right input channel audio signal and inserting the correlated content into the center channel signal, to provide a modified left input channel audio signal, a modified right input channel audio signal, and a modified center input channel audio signal;

a first directional loudspeaker, for directionally radiating the modified left audio channel signal so that radiation in a direction toward a listening location is less than radiation in other directions;

a second directional loudspeaker, for directionally radiating the modified right channel audio signal so that radiation in a direction toward a listening location is less than radiation in other directions; and a third loudspeaker, for radiating the modified center channel.

2. An audio system according to claim 1, wherein the first directional loudspeaker comprises a first interference array.

3. An audio system according to claim 2, wherein the second directional loudspeaker comprises a second interference array.

4. An audio system according to claim 3, wherein the first directional loudspeaker and the second directional loudspeaker comprise at least one common acoustic driver.

5. An audio system according to claim 1, wherein the third loudspeaker is a third directional loudspeaker for directionally radiating the modified center channel audio signal so that radiation in a direction toward a listening location is less than radiation in other directions.

6. An audio system according to claim 1, wherein the third loudspeaker is a third directional loudspeaker for directionally radiating the modified center channel audio signal so that radiation in a direction toward a listening location is greater than radiation in other directions.

7. An audio system according to claim 5, wherein the third directional loudspeaker comprises an interference array.

8. An audio system according to claim 7, wherein the first directional loudspeaker comprises a first interference array;

the second directional loudspeaker comprises a second interference array;

the third directional loudspeaker comprises a third interference array; and wherein the first interference array and the third interference array comprise a common acoustic driver; and the second interference array and the third interference array comprise a common acoustic driver.

9. An audio system according to claim 5, further comprising an acoustically opaque barrier between the third directional loudspeaker and the listening location.

10. An audio system according to claim 1, implemented in a television.

11. An audio system according to claim 10, wherein the third loudspeaker is a third directional loudspeaker, for directionally radiating the modified center channel audio signal so that radiation in a direction toward a listening location is less than radiation in other directions.

12. An audio system according to claim 10, wherein the third loudspeaker is a third directional loudspeaker, for directionally radiating the modified center channel audio signal so that radiation in a direction toward a listening location is greater than radiation in other directions.

13. An audio system according to claim 11, wherein the third directional loudspeaker comprises an interference array.

14. A method comprising receiving a left channel audio signal, a right channel audio signal, and a discrete center channel audio signal;

removing correlated content from the left channel audio signal and the right channel audio signal to provide a modified left channel audio signal and a modified right channel audio signal;

combining the correlated content with the discrete center channel audio signal;

radiating the modified left channel audio signal and the modified right audio channel audio signal directionally so that the radiation toward a listening position is less than the radiation in other directions.

15. The method of claim 14, wherein the radiating the modified left channel audio signal comprises radiating with a first interference array and the radiating the modified right channel audio signal comprises radiating with a second interference array.

16. The method of claim 15, wherein the first interference array and the second interference array comprise a common acoustic driver.

17. Audio signal circuitry comprising:

circuitry to remove correlated content from a left channel audio signal and a right channel audio signal to provide a modified left channel audio signal and a modified right channel audio signal;

circuitry to combine the correlated content with a discrete center channel audio signal to provide a modified discrete center channel; and first processing circuitry to process the modified left channel audio signal so that the modified left channel audio signal is directionally radiatable by a first interference array;

and second processing circuitry to process the modified right channel audio signal so that the modified right channel audio signal is directionally radiatable by a second interference array.

18. Audio signal processing circuitry according to claim 17, wherein the first processing circuitry processes the modified left channel audio signal and the second processing circuitry modifies right channel audio signal so that the first interference array and the second interference array include a common acoustic driver.

19. Audio signal processing circuitry according to claim 17, further comprising third processing circuitry to process the modified discrete center channel so that the modified discrete center channel is directionally radiatable by an interference array.

20. Audio signal processing circuitry according to claim 19, wherein the third circuitry processes the modified discrete center channel so that the third directional array and the first directional array have a common acoustic driver and so that the third directional array and the second directional array have a common acoustic driver.

* * * * *